United States Patent [19]

Ogawa

[11] 4,330,694

[45] May 18, 1982

[54] COMPLEX SWITCH ASSEMBLY

[75] Inventor: Akira Ogawa, Iwakura, Japan

[73] Assignee: Kabushiki Kaisha Tokai Rika Denki Seisakusho, Aichi, Japan

[21] Appl. No.: 117,305

[22] Filed: Jan. 31, 1980

[30] Foreign Application Priority Data

Nov. 5, 1979 [JP] Japan ..... 54/153339[U]

[51] Int. Cl.[3] ..... H01H 25/04

[52] U.S. Cl. ..... 200/6 A

[58] Field of Search ..... 200/6 A, 17 R, 18

[56] References Cited

U.S. PATENT DOCUMENTS

| | | | |
|---|---|---|---|
| 3,814,871 | 6/1974 | Osika | 200/6 A |
| 3,818,154 | 6/1974 | Presentey | 200/6 A |
| 3,827,313 | 8/1974 | Kiessling | 200/6 A X |
| 3,918,021 | 11/1975 | Nishioka et al. | 200/6 A X |
| 4,041,258 | 8/1977 | Harada | 200/6 A |

*Primary Examiner*—James R. Scott

*Attorney, Agent, or Firm*—Wenderoth, Lind & Ponack

[57] ABSTRACT

A complex switch assembly specially for use in a motor vehicle for controlling positions of rear viewing mirrors provided on left and right-hand sides of the motor vehicle includes an operating lever constituted by a sphere, a bar portion extending radially outwardly from the sphere and a leg portion extending radially outwardly from the sphere in a direction opposite to the bar portion. The sphere is rotatably supported in a casing so that the operating lever can be rotated between first and second neutral positions about the axis of the operating lever and also can be tilted in four directions about the center of the sphere from each of the neutral positions. The leg portion controls a switch mechanism in accordance with the tilting of the operating lever.

10 Claims, 28 Drawing Figures

| POSITION \ CONDUCTORS | | B | E | m1 | m2 | M2 | SL | SR |
|---|---|---|---|---|---|---|---|---|
| LEFT MIRROR | UP | ○ | ○ | ○ | | ○ | ○ | |
| | DOWN | ○ | ○ | ○ | | ○ | ○ | |
| | OFF | | | | | | | |
| | LEFT | ○ | ○ | ○ | | ○ | | |
| | RIGHT | ○ | ○ | ○ | | ○ | | |
| RIGHT MIRROR | UP | ○ | ○ | | ○ | ○ | | ○ |
| | DOWN | ○ | ○ | | ○ | ○ | | ○ |
| | OFF | | | | | | | |
| | LEFT | ○ | ○ | | ○ | ○ | | |
| | RIGHT | ○ | ○ | | ○ | ○ | | |

Symbol ○—○ indicates connection between conductors

| Position | | Conductors | $H_1$ | $V_1$ | $H_2$ | $V_2$ | COM | B | E |
|---|---|---|---|---|---|---|---|---|---|
| LEFT MIRROR | $M_1$ | LEFT | ○—○ | | | | ○—○ | ○—○ | ○—○ |
| | | RIGHT | ○—○ | | | | ○—○ | ○—○ | ○—○ |
| | | OFF | | | | | | | |
| | $M_2$ | UP | | ○—○ | | | ○—○ | ○—○ | ○—○ |
| | | DOWN | | ○—○ | | | ○—○ | ○—○ | ○—○ |
| RIGHT MIRROR | $M_3$ | LEFT | | | ○—○ | | ○—○ | ○—○ | ○—○ |
| | | RIGHT | | | ○—○ | | ○—○ | ○—○ | ○—○ |
| | | OFF | | | | | | | |
| | $M_4$ | UP | | | | ○—○ | ○—○ | ○—○ | ○—○ |
| | | DOWN | | | | ○—○ | ○—○ | ○—○ | ○—○ |

Symbol ○—○ indicates connection between conductors

*Fig. 26*

| MOVEMENT OF LEVER Q | | MOVEMENT OF CONTACTS | CONNECTION |
|---|---|---|---|
| LEFT MIRROR | LEFT | RIGHT | B → H1 → M1 → COM. → E |
| | RIGHT | LEFT | B → COM. → M1 → H1 → E |
| | UP | DOWN | B → V1 → M2 → COM. → E |
| | DOWN | UP | B → COM. → M2 → V1 → E |
| RIGHT MIRROR | LEFT | RIGHT | B → H2 → M3 → COM. → E |
| | RIGHT | LEFT | B → COM. → M3 → H2 → E |
| | UP | DOWN | B → V2 → M3 → COM. → E |
| | DOWN | UP | B → COM. → M3 → V2 → E |

COMPLEX SWITCH ASSEMBLY

BACKGROUND OF THE INVENTION

The present invention relates to a complex switch assembly and, more particularly, to a switch assembly which can establish one or more of a plurality of, for example, eight, different connections by the operation of one switch lever.

Generally, a motor vehicle has two rear viewing mirrors, one on each of the left and right fenders. Recently, it has become popular to equip automobiles with rear viewing mirrors which can be adjusted from inside the vehicle. For this purpose, each mirror is centrally pivotable about its horizontal and vertical axes using screws connected with the back of the pivotable mirror, said screws being adapted to be advanced or retracted by rotatable nuts, driven either by separate motors and worms or by a single motor and worm pivoted at the opposite end of the motor to selectively engage one or the other of the nuts.

For adjusting the position of such rear viewing mirrors from inside the vehicle, a switch assembly therefor must be provided on a dashboard or on a vehicle frame at a position which is preferably within the reach of the driver.

Since each of the rear viewing mirrors can be pivoted about its horizontal axis to turn the mirror face upwards or downwards, and also can be pivoted about its vertical axis to turn the same leftwards or rightwards, it is necessary to provide a switch assembly which can take four different operative positions for adjusting one rear viewing mirror, that is, eight different operative positions for adjusting two rear viewing mirrors.

SUMMARY OF THE INVENTION

Accordingly, it is a primary object of the present invention to provide an improved complex switch assembly which has a simple construction, is small in size and can be readily manufactured at low cost.

It is another object of the present invention to provide a complex switch assembly of the above described type which is simple to operate.

It is a further object of the present invention to provide a compled switch assembly of the above described type which establishes a reliable electric connection in each operative position.

In accordance with a preferred embodiment of the invention, the complex switch assembly comprises a casing having an open-ended hollow interior defined therein and a top plate closing one open-end of the casing and having a first opening defined therein. A supporting member having a second opening at its center is rigidly provided in the hollow interior with the first and second openings in alignment with each other. The complex switch assembly further comprises an operating lever constituted by a sphere, a bar portion extending radially outwardly from the sphere and a leg portion extending radially outwardly from the sphere in a direction opposite to the bar portion. The sphere has a diameter larger than the size of either of the first and second openings, and is held in position between the top plate and the supporting member with its local areas partially protruding into the first and second openings. The bar portion extends outwardly from the casing through the first opening and the leg portion extends through the second opening. The operating lever can be located in one of a plurality of differnt neutral positions when the bar portion and the leg portion are in alignment with an imaginary line extending between the centers of the first and second openings. The operating lever is capable of being rotated about the axis of the bar portion when the operating lever is in any one of the neutral positons to bring the same to a different one of the neutral positions and also capable of being tilted about the center of the sphere in a plurality of directions when the operating lever is in any one of the neutral positions.

A switching mechanism is provided at the opposite open-end of the hollow interior. The switching mechanism is actuated in association with the movement of the leg portion of the operating lever.

According to a preferred embodiment of the present invention, the switching mechanism comprises a printed circuit board rigidly held in the casing adjacent to one end of the leg portion remote from the sphere and in a perpendicular relation to the leg portion when the operating lever is located in any one of the neutral positions. The printed circuit board has a printed surface with a plurality of conductive strips thereon facing the leg portion. The switching mechanism further comprises contact means located above the printed surface of the printed circuit board and pivotally connected to one end portion of the leg portion remote from the sphere. The contact means carries at least one contact member made of electrically conductive material and held in contact with the printed surface of the printed circuit board. The contact means can be rotated about the axis of the leg portion in accordance with the rotation of the operating lever and is shifted over the printed surface to one of a plurality of operative positions in accordance with the tilting of the operating lever in one of the directions. When the contact means is selectively shifted to one of the operating positions, the contact member bridges at least two of the conductive strips for establishing an electric connection therebetween.

BRIEF DESCRIPTION OF THE DRAWINGS

The foregoing and other objects and features and advantages of the invention will be apparent from the following description of the invention with reference to the accompanying drawings in which:

FIG. 26 is a chart showing the flow of current through various points in the circuit of FIG. 24;

DETAILED DESCRIPTION OF THE INVENTION

Figure 1:
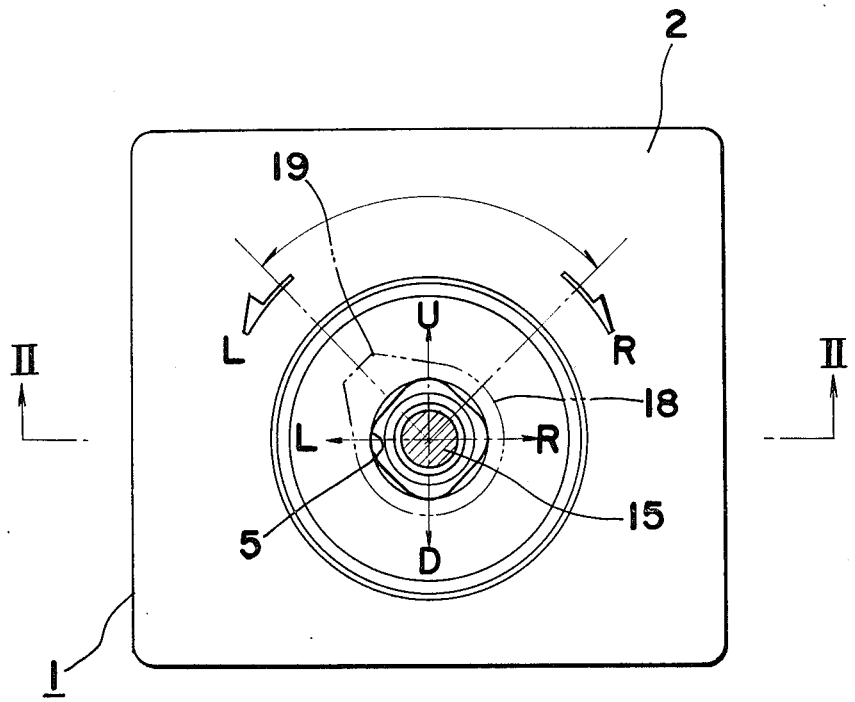
FIG. 1 is a top plan view of a complex switch assembly according to the first embodiment of the present invention.

Before the description of the present invention proceeds, it is to be noted that the present invention is explained by way of two embodiments. The first embodiment is explained with reference to and shown in FIGS. 1 to 12 and the second embodiment is explained with reference to and shown in FIGS. 13 to 26. In each of the embodiments, like parts are designated by like reference numerals throughout the drawings.

First embodiment

Figure 2:
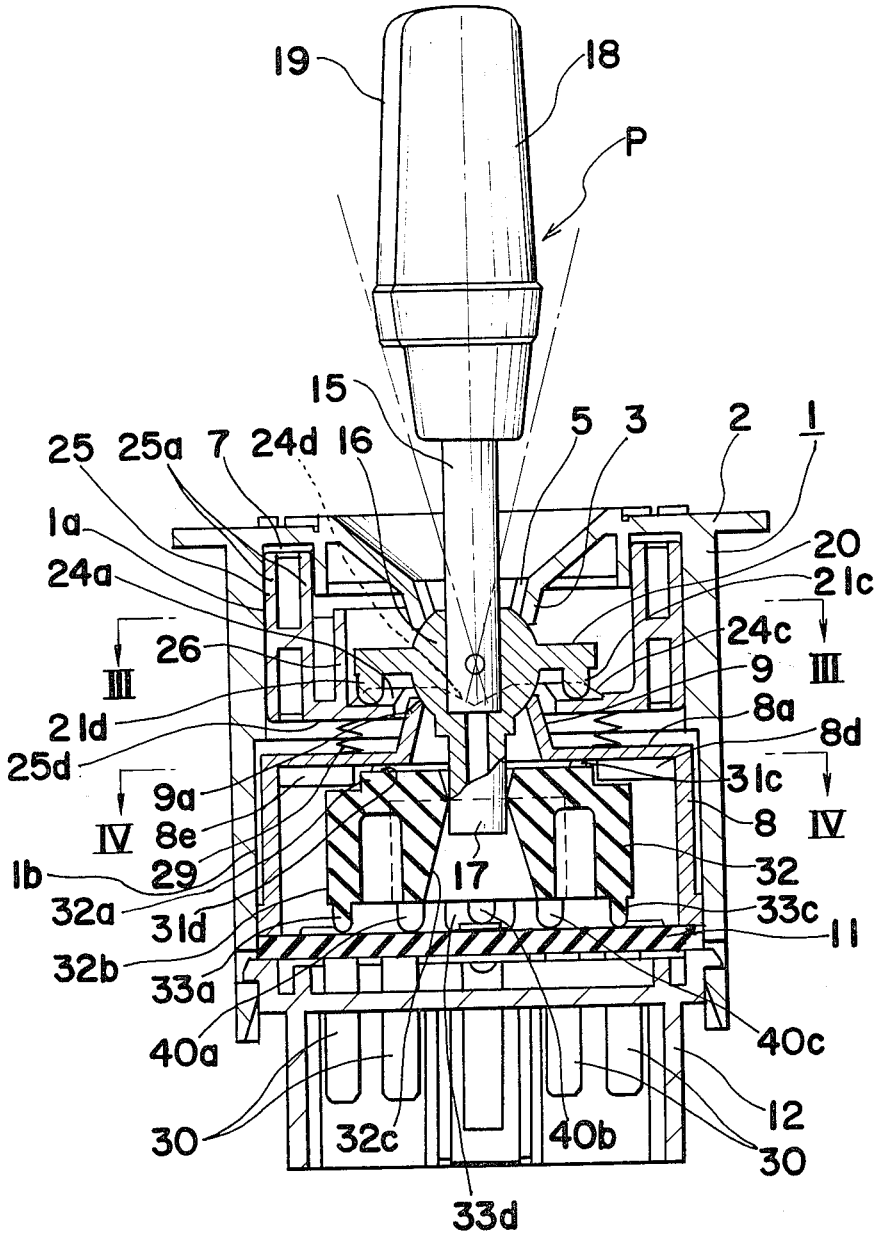
FIG. 2 is a cross-sectional view taken along the line II—II shown in FIG. 1.

Referring to FIGS. 1 and 2, the first embodiment of a complex switch assembly includes a casing 1 having a box-like configuration with a hollow interior housing upper and lower compartments 1*a* and 1*b* defined therein. The upper compartment 1*a* is cylindrical in section and the lower compartment 1*b* is rectangular in section. The casing 1 has a top plate 2 which is has, at its center, with a funnel-shaped or tapered projection 3 extending inwardly into the casing 1. The tapered end is open. The wall 5 defining the tapered projection 3 is wave-shaped, as best shown in FIG. 1, for forming a cross-shaped opening 5. The bottom of the casing 1 is closed by a contact means in the form of a printed circuit board 11 which will be described in detail later with particular reference to FIG. 5.

In the upper compartment 1*a* and under the top plate 2, there is provided an annular groove 7 for receiving a cylindrical sliding member 25 movable in a vertical direction parallel to the axis of the cylindrical sliding member 25.

Figure 3:
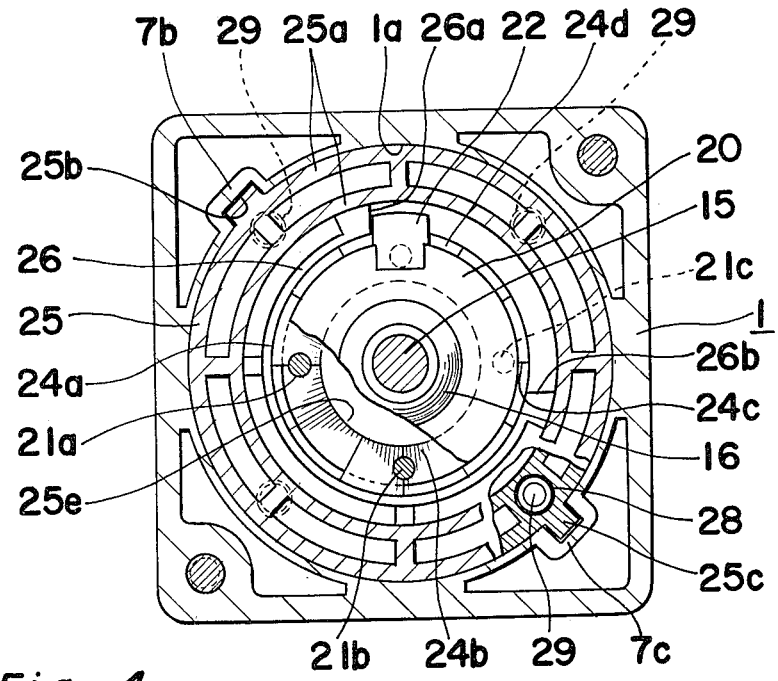
FIG. 3 is a cross-sectional view taken along the line III—III shown in FIG. 2.

The cylindrical sliding member 25 has an outer cylindrical wall portion 25*a* which is slidingly inserted in the groove 7. The outer cylindrical wall portion 25*a* has, as best shown in FIG. 3, two projections 25*b* and 25*c* extending radially outwardly therefrom. These two projections 25*b* and 25*c* are slidingly engaged, respectively, in elongated grooves 7*b* and 7*c* formed in the cylindrical wall of the upper compartment 1*a* and extending in a vertical direction parallel to the axis of the sliding member 25 so that the cylindircal sliding member 25 can move up and down in the upper compartment 1*a* without any rotation about the axis of the member 25.

The cylindrical sliding member 25 is further provided with a bottom plate 25*d* having an opening 25*e* (FIG. 3) formed in the center. Provided on the bottom plate 25*d* adjacent to the cylindrical wall 25*a* is an engagement wall 26 which extends approximately 270° around the axis of the member 25, as best shown in FIG. 3. Also provided on the base plate 25*d* along the edge of the circular opening 25*e* is four V-shaped recesses 24*a*, 24*b*, 24*c* and 24*d*, each adjacent two of which are circumferentially spaced 90° from each other.

Figure 7:
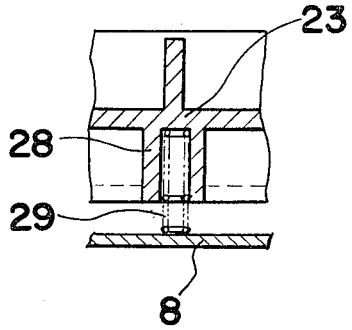
FIG. 7 is a side sectional view of a portion of a cylindrical member incorporated in the complex switch assembly of FIG. 1.
Figure 9:
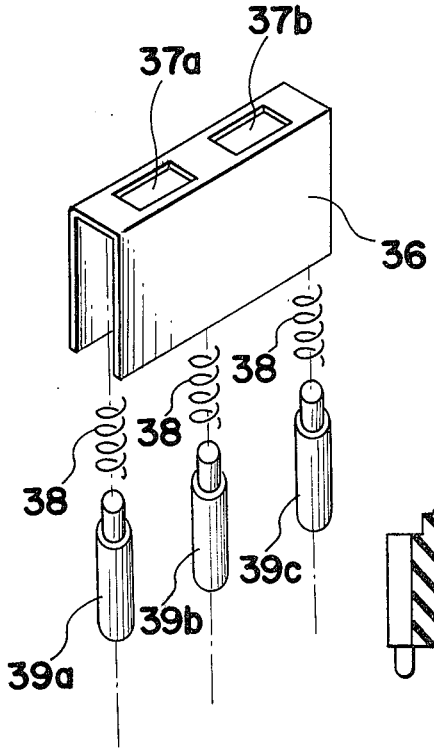
FIG. 9 is an exploded perspective view of a frame and connecting pins incorporated in the movable contact member of FIG. 8.

The cylindrical sliding member 25 is normally biased upward, when viewed in FIG. 2, by four biasing springs 29 each extending between the cylindrical sliding member 25 and a supporting member 8 which is incorporated in the lower compartment 1*b*. For securing the biasing springs 29 in position, the cylindrical sliding member 25 has recesses 28 formed in the base plate 25*d* for accommodating the respective springs 29, as best shown in FIG. 7.

The supporting member 8 has four side walls snugly engaged in the lower compartment 1*b* of the casing 1 and a top plate 8*a* which has a tapered projection 9 extending upwardly from its center. The tapered end of the projection 9 is located within the opening 25*e* in the bottom plate 25*d* of the cylindrical sliding member 25 and has an opening 9*a*.

A sphere 16 is rotatably held between the tapered projection 3 and the tapered projection 9. Extending upward from the sphere 16 (FIG. 6) is a bar 15 having a circular cross-section. The free end of the bar 15 remote from the sphere 16 has rigidly connected thereto a knob 18 having a fin 19 which is provided for indicating the position of the knob 18 about its axis. Extending downward from the sphere 16 in the direction opposite to the bar 15 is a leg 17 having a rectangular cross-section. The sphere 16 is further provided with a ring plate 20 (FIG. 6) which protrudes radially outwardly of the sphere 16 and in a direction perpendicular to the axis of the bar 15. The ring plate 20 has four projections 21*a*, 21*b*, 21*c* and 21*d* which extend downwardly therefrom, each adjacent two of the pins 21*a* to 21*d* being peripherally spaced 90° from each other. The ring plate 20 also has an engagement projection 22 extending outwardly from the peripheral edge of the ring plate 20.

Referring particularly to FIG. 3, when the sphere 16 is rotated about the axis of the bar 15 in a counterclockwise direction by rotating the knob 18 about the axis of the bar 15, the engagement projection 22 comes into contact with one end 26*a* of the engagement wall 26 to hold the sphere 16 in a first neutral position. In the first neutral position of the sphere 16 as shown, the projections 21*a*, 21*b*, 21*c* and 21*d* are engaged, respectively, in V-shaped recesses 24*a*, 24*b*, 24*c* and 24*d* formed in the bottom plate 25*d* of the cylindrical sliding member 25. Since the cylindrical sliding member 25 is urged upwardly by the biasing springs 29, the projections 21*a* to 21*d* are held tightly in contact with the corresponding recesses 24*a* to 24*d* for securing the sphere 16 in the first neutral position.

On the other hand, when the sphere 16 is rotated about the axis of the bar 15 in a clockwise direction, the engagement projection 22 comes into contact with the other end 26*b* of the engagement wall 26 to hold the sphere 16 in a second neutral position. In the second neutral position of the sphere 16, the projections 21*a*, 21*b*, 21*c* and 21*d* are engaged, respectively, in V-shaped recesses 24*d*, 24*a*, 24*b* and 24*c* for securing the sphere 16 in position.

Figure 10:
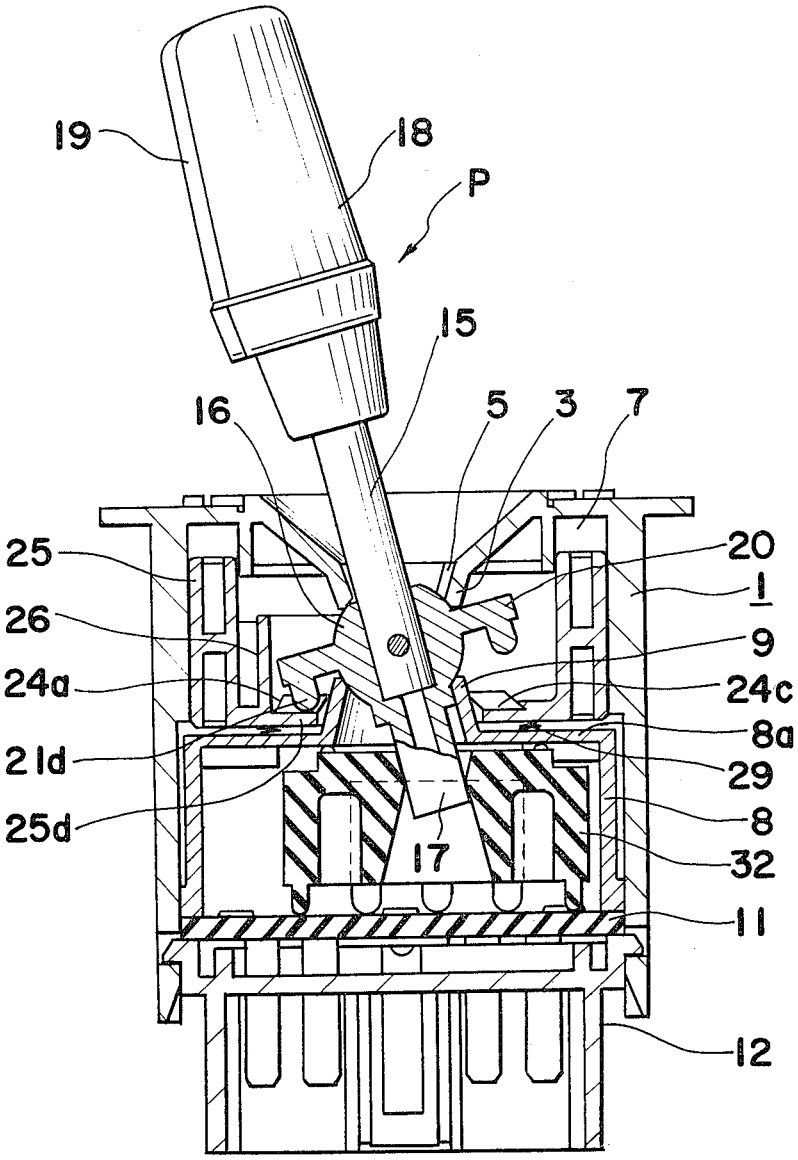
FIG. 10 is a view similar to FIG. 2, but particularly showing the operating lever tilted in one of a plurality of directions.

In addition to the above rotation, the sphere 16 is also rotatable about two axes perpendicular to the bar 15, and this can be achieved by tilting the bar 15 about the center of the sphere 16 by the application of an external force to the knob 18. The direction of tilting is defined by the wave-shaped wall 5 forming the tapered projection 3. Therefore, when viewed from the top and as shown in FIG. 1, the bar 15 can be tilted in four directions, i.e., right, left, up and down directions which are indicated by arrows R, L, U and D. FIG. 10 shows the complex switch assembly in which the bar 16 is tilted in the direction L. When the bar 15 is tilted, one of the projections 21*a* to 21*d* pushes the cylindrical sliding member 25 down against the biasing spring 29. However, when the external force on the knob 18 is released, the cylindrical sliding member 25 is raised for returning the ring plate 20 back to a horizontal position as shown in FIG. 2, causing the bar 15 to assume a neutral position.

It is to be noted that, only during the time when the bar 15 assumes this neutral position can the bar 15 be rotated about its own axis to bring the sphere 16 selectively into the first and second neutral positions.

Since the sphere 16, bar 15, leg 17 and knob 18 are integrally joined with each other, they are, as a whole, generally referred to as an operating lever P.

Figure 4:
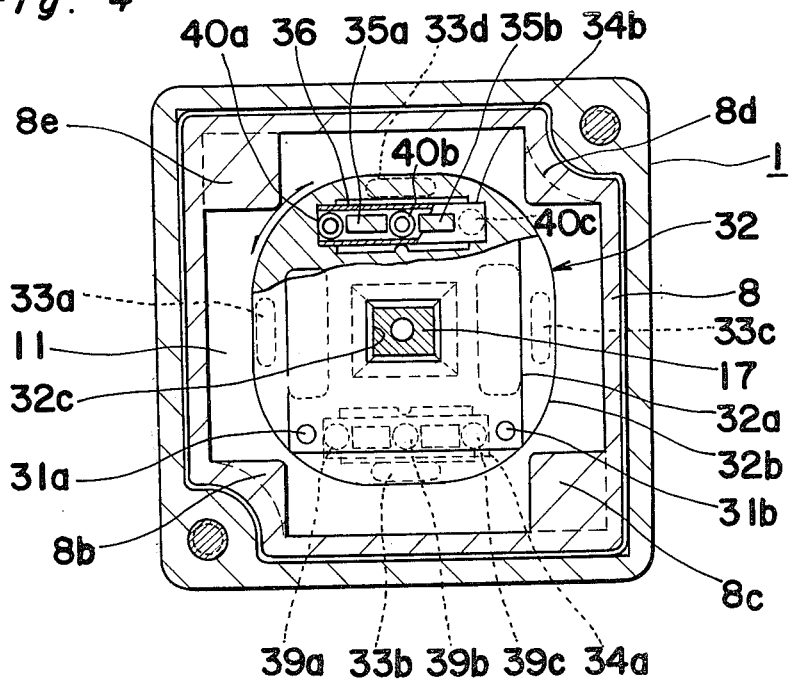
FIG. 4 is a cross-sectional view taken along the line IV—IV shown in FIG. 2.

Still referring FIG. 2, a movable contactor member 32 is movably housed in the supporting member 8. The movable contactor member 32 has a head portion 32*a* and a body portion 32*b*. The head portion 32*a*, when viewed from the top and as shown in FIG. 4, has a square configuration and the body portion has a square configuration with rounded corners. A rectangular opening 32*c* extends from top to bottom of the movable contactor member 32 through its center. The opening 32*c* is, as shown in FIG. 2, so sized and so shaped as to have a configuration which is wide at the top, then gradually narrowed until it reaches a level slightly under the border between the head portion 32*a* and the body portion 32*b*, and finally gradually widened again. The most constricted portion of the opening 32*c* has the rectangular leg 17 extending from the sphere 16 fitted thereon so that the movement of the operating lever P can move the movable contactor member 32 in a plane parallel to the printed circuit board 11. More particularly, when the operating lever P is rotated to bring the sphere 16 into the first neutral position, the movable contactor member 32 is rotated correspondingly to assume a first off position. On the other hand, when the operating lever P is rotated to bring the sphere 16 into the second neutral position, the movable contactor member 32 is brought to a second off position. From each of the off positions, the movable contactor member 32 can be shifted in four directions, i.e., right, left, back and forth directions in accordance with the tilting of the operating lever P in the corresponding directions L, R, U and D. For guiding the movable contactor member 32 being shafted in each of the directions, there are provided four guide blocks 8*b*, 8*c*, 8*d* and 8*e* each at a corner under the top plate 8*a*. In this arrangement, the head portion 32*a* of the movable contactor member 32 is guided between two guide blocks. For example, when viewed in FIG. 2, the head portion 32*a* is guided between the guide blocks 8*e* and 8*d* when the contactor member is shifted back as a result of tilting of the bar 15 towards front. The guide blocks also prevent the contactor member 32 from being rotated when shifted in one of the four directions.

The movable contactor member 32 has four spacer projections 33*a*, 33*b*, 33*c* and 33*d* extending downwards from four side edge portions thereof from the body portion 32*b* for spacing the movable contactor member 32 a predetermined distance from the printed circuit board 11. Similarly, four spacer projections 31*a*, 31*b*, 31*c* and 31*d* are provided on the top of the head portion 32*b* at four corners of the contactor member 32 for spacing the movable contactor member 32 a predetermined distance from the supporting member 8. The movable contactor member 32 further has two rectangular recesses 34*a* and 34*b* in the bottom surface of the body portion 32*b*; one rectangular recess 34*a* is located adjacent to the spacer projection 33*b*; and the other rectangular recess 34*b* is located adjacent to the spacer projection 33*d*.

Figure 8:
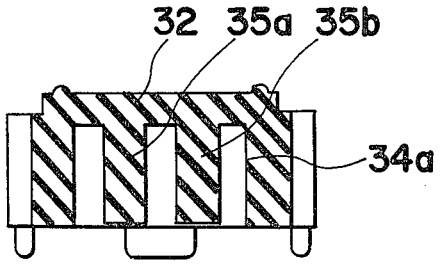
FIG. 8 is a fragmentary side sectional view of a movable contact member incorporated in the complex switch assembly of FIG. 1.

Referring to FIG. 8, two separation projections 35*a* and 35*b* made of electrically non-conductive material are provided in each recess 34*a* or 34*b* for dividing the respective recess into three parts. In each recess 34*a* or 34*b*, a metal frame 36 (FIG. 9) of generally U-shaped cross-section and having two openings 37*a* and 37*b* therein is held in position with the separation projections 35*a* and 35*b* fitted in and extending through the openings 37*a* and 37*b*. Three connecting pins 39*a*, 39*b* and 39*c* made of metal and each carrying a metal spring 38 are positioned in the respective three parts of the recess 34*a* and within the metal frame 36. Similarly, three connecting pins 40*a*, 40*b* and 40*c*, each carrying a metal spring 38 are positioned in the respective three parts of the recess 34*b* within a similar metal frame.

When the movable contactor member 32 provided with the connecting pins 39*a*, 39*b*, 39*c*, 40*a*, 40*b* and 40*c* is accommodated in the lower compartment 1*b*, rounded ends of the connecting pins 39*a* to 40*c* are held in contact with the printed circuit board 11 under the influence of the biasing force of the respective metal spring 38. Since the connecting pins 39*a*, 39*b* and 39*c* are electrically connected with each other through the springs 38 and the metal frame 36, the points on the circuit board 11 in contact with the pins 39*a*, 39*b* and 39*c* are electrically connected with each other. Similarly, the points on the circuit board 11 in contact with the pins 40*a*, 40*b* and 40*c* are electrically connected with each other.

Figure 5:
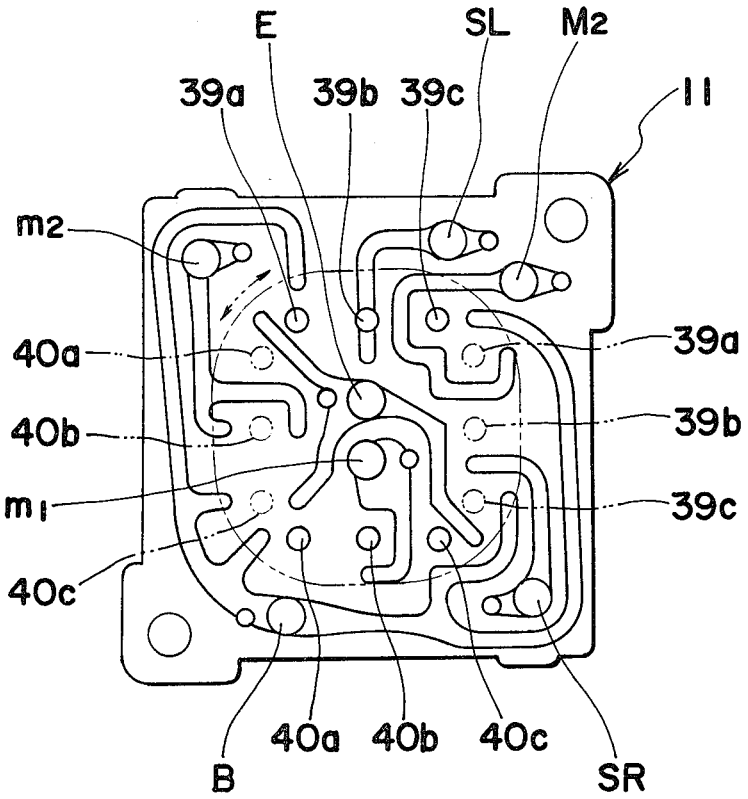
FIG. 5 is a top plan view of a printed circuit board incorporated in the complex switch assembly shown in FIG. 1.
Figure 6:
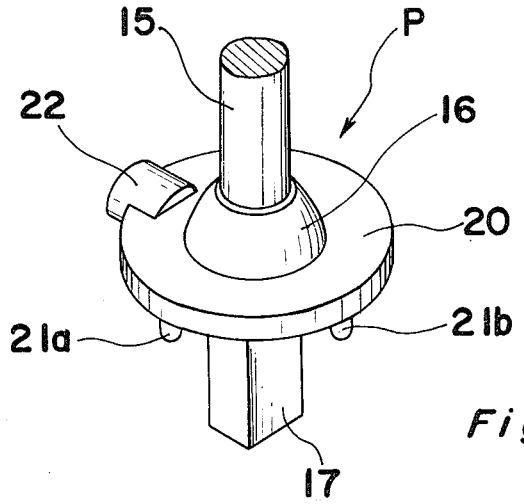
FIG. 6 is a perspective view of a major part of an operating lever incorporated in the complex switch assembly of FIG. 1.
Figures 11, 12:
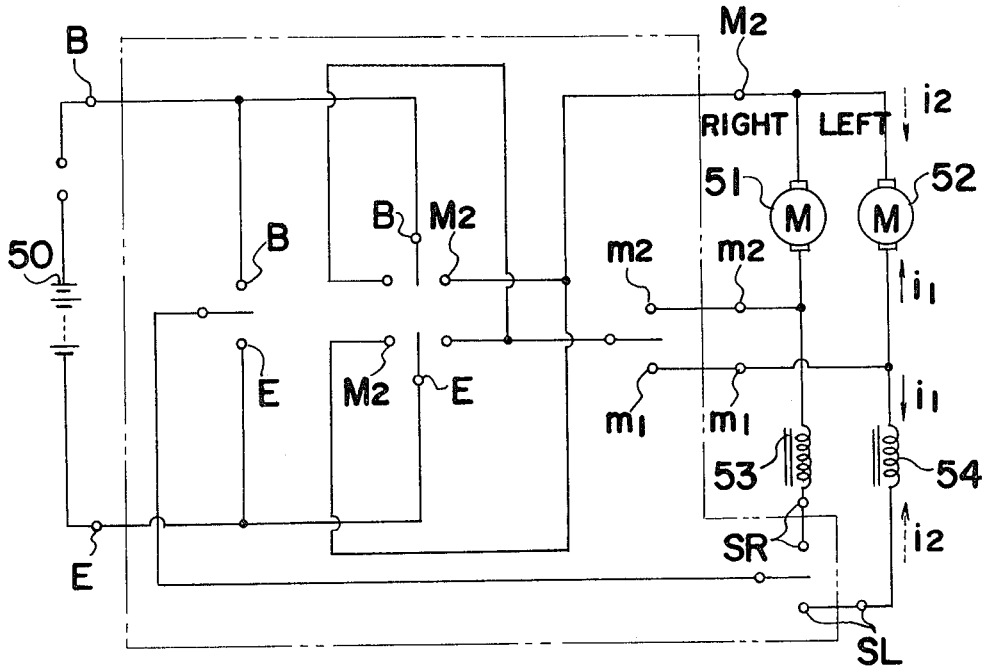
FIG. 11 is a circuit diagram of the complex switch assembly of FIG. 1 connected with and external circuit.
FIG. 12 is a chart showing connections of connecting pins.

Referring to FIG. 5, there is shown a pattern of the printed circuit on the circuit board 11. Deposited on the circuit board 11 are seven conductive strips which are respectively designated by reference characters B, E, m1, m2, M2, SL and SR. Each of these conductive strips is connected to a corresponding one of seven terminal legs 30 (FIG. 2) provided under the circuit board 11 and adapted to be connected to an external circuit which is shown in FIG. 11. The terminal legs 30 are surrounded by a frame 12 which is inserted into the casing 1 from the bottom and engaged therein.

Referring to FIG. 11, the circuit enclosed by the chain line corresponds to the circuit of the complex switch assembly according to the present invention. The conductive strip B is connected to a positive side of a source of power such as a battery 50 and the conductive strip E is connected to a negative side of the battery 50. A D.C. motor 51 which is a type capable of rotating in both directions depending on the direction of flow of an electric current therethrough is connected between the conductive strips M2 and m2. A D.C. motor 52 of the same type as the motor 51 is connected between the conductive strips M2 and m1. A solenoid 53 is connected between the conductive strips m2 and SR, and a solenoid 54 is connected between the conductive strips m1 and SL.

It is to be noted that the motor 51 and the solenoid 53 are provided for controlling the angular position of a rear viewing mirror provided on the front right-hand side of a vehicle (not shown), and the motor 52 and the solenoid 54 are provided for controlling the angular position of a rear viewing mirror provided on the front left-hand side of the vehicle. More particularly, each of the rear viewing mirror is centrally pivotable about horizontal and vertical axes using screws connected with the back of the pivotable mirror, which are adapted to be advanced or retracted by rotatable nuts driven by a single motor and worm pivoted at the opposite end of the motor to selectively engage one or the other of the nuts. The pivotal movement of the worm is effected by the respective solenoid which brings the worm in engagement with one nut when it is not energized and in engagement with the other nut when it is energized. Therefore, when only the motor 51 is energized, right and left angular position of the right-hand rear viewing mirror are controlled and, when the motor 51 and the solenoid 53 are energized, the up and down angular position of the right-hand rear viewing mirror is controlled. In a similar manner, when only the motor 52 is energized, right and left angular position of the left-hand rear viewing mirror is controlled and, when the motor 52 and the solenoid 54 are energized, the up and down position of the left-hand rear viewing mirror is controlled. Since the above mentioned arrangement of the mirrors in association with motors and solenoids is known in the prior art, for example, from U.S. Pat. No. 3,972,597 to Repay et al. of Aug. 3, 1976 or U.S. Pat. No. 4,056,253 to Repay et al. of Nov. 1, 1977, a further description thereof is omitted for the sake of brevity. Furthermore, since the present invention is concerned with the complex switch assembly, any other known rear viewing mirror arrangments can be employed.

Referring again to FIG. 5, when the bar 15 is rotated to locate the sphere 16 in the first neutral position, that is, when the operating lever P is rotated to the first neutral position, the connecting pins 39*a*, 39*b*, 39*c*, 40*a*, 40*b* and 40*c* are located at positions indicated by the solid lines. On the other hand, when the bar 15 is rotated to locate the sphere 16 in the second neutral position, that is, when the operating lever P is rotated to the second neutral position, the connecting pins 39*a* to 40*c* are located at positions indicated by the dotted lines.

When the operating lever P positioned in the first neutral position is tilted in the direction U shown in FIG. 1, the connecting pins 39*a*, 39*b* and 39*c* shown in FIG. 5 are shifted downwards a predetermined distance for contacting contact portions of the conductive strips E, SL and M2 and connecting the strips with each other and, at the same time, the connecting pins 40*a*, 40*b* and 40*c* are shifted down for connecting contact portions on the conductive strips m1 and B and connecting the strips with each other. The above described connections are shown in the chart of FIG. 12. When the above connections are effected, current flows through the motor 52 and the solenoid 54 in the direction indicated by the arrow $i_1$ for effecting upward angular movement of the left-hand rear viewing mirror.

When the operating lever P positioned in the first neutral position is tilted in the direction D shown in FIG. 1, the connecting pins 39*a* to 39*c* are shifted upwards a predetermined distance for connecting the conductive strip B, SL and M2 with each other and, at the same time, the connecting pins 40*a* to 40*c* are shifted up for connecting the conductive strips m1 and E with each other. When the above connections are effected, current flows through the motor 52 and the solenoid 54 in the direction indicated by the arrow $i_2$ for effecting downward angular movement of the left-hand rear viewing mirror.

When the operating lever P positioned in the first neutral position is tilted in the direction L shown in FIG. 1, the connecting pins 39*a* to 39*c* are shifted rightwards a predetermined distance for connecting the conductive strips M2 and B with each other and, at the same time, the connecting pins 40*a* to 40*c* are shifted rightwards a predetermined distance for connecting the conductive strips m1 and E with each other. When the above connections are effected, current flows only through the motor 52 in the direction $i_2$ for effecting leftwards angular movement of the left-hand rear viewing mirror.

When the operating lever P positioned in the first neutral position is tilted in the direction R shown in FIG. 1, the connecting pins 39*a* to 39*c* and 40*a* to 40*c* are shifted leftwards a predetermined distance for connecting the conductive strips E and M2 with each other and conductive strips B and m1 with each other for allowing current to flow only through the motor 52 in the direction $i_1$, thus effecting rightwards angular movement of the left-hand rear viewing mirror.

The above operations apply to the case where the operating lever P in the first neutral position is tilted for controlling the angular position of the left-hand rear viewing mirror. A similar angular adjustment of the right-hand mirror is carried out when the operating lever P in the second neutral position is tilted for effecting similar electric connections to those described above. Therefore, a further description thereof is omitted.

It is to be noted that the top plate 2 can be marked with arrows and characters for indicating the direction of turning and/or tilting of the operating lever P.

Second embodiment

Figure 13:
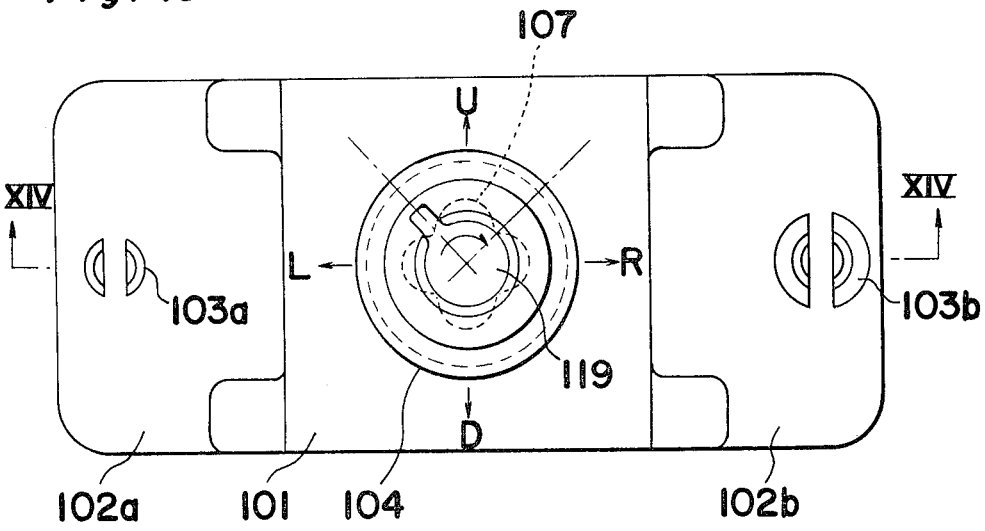
FIG. 13 is a top plan view of a complex switch assembly according to the second embodiment of the present invention.
Figure 14:
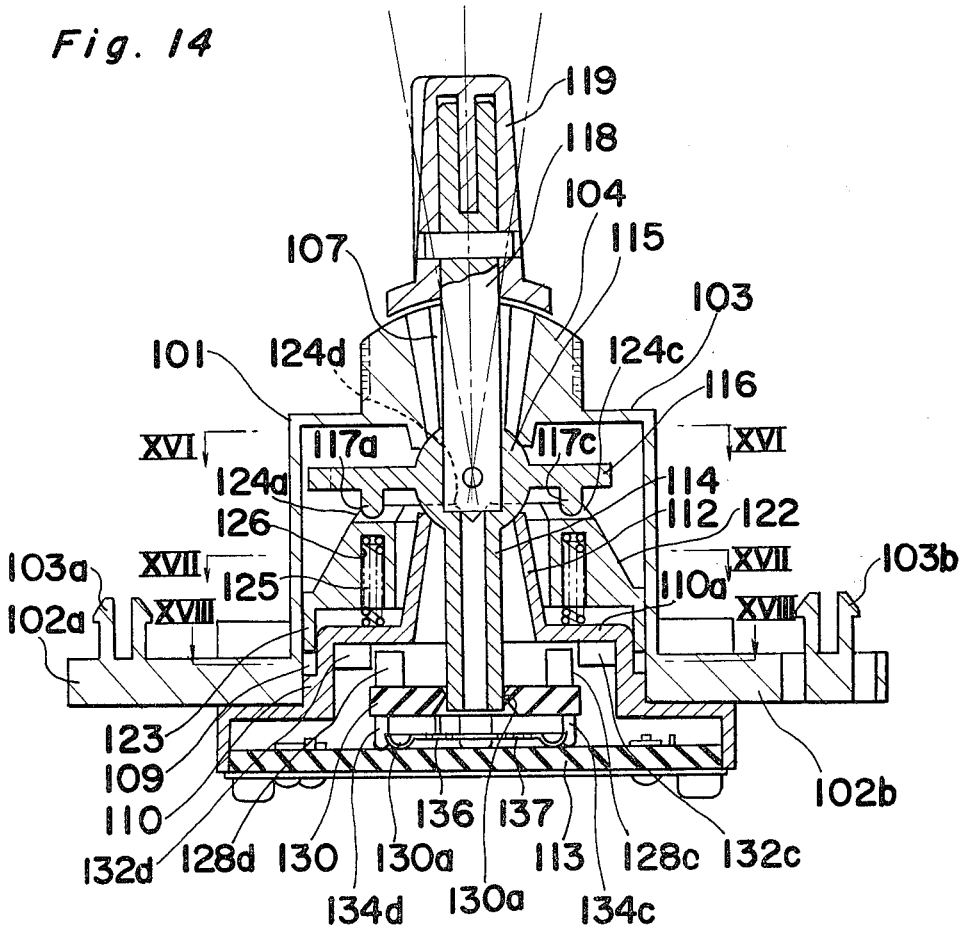
FIG. 14 is a cross-sectional view taken along the line XIV—XIV shown in FIG. 13.

Referring to FIGS. 13 and 14, the second embodiment of the complex switch assembly includes a casing 101 having a box-like configuration with a pair of flanges 102*a* and 102*b* protruding outwards from opposite ends of a lower open end of the casing 101. The upper end of the casing 101 is closed by a top plate 103 which has a projection 104 extending upwards from the center of the top plate 103. The projection 104 has an opening 107 which extends from the top of the projection 104 into the casing 101. The opening 107 is wide at the top and is narrowed towards the casing 101. Since the wall defining the opening 107 is wave-shaped, as best shown in FIG. 13, the opening 107 has a cross-shape. It is to be noted that wall defining the opening 107 extends slightly into the casing 101.

Referring particularly to FIG. 14, a supporting member 110 is inserted into and fitted in the casing 101 from the open end of the casing 101. The supporting member 110 has a top plate 110*a* which has a tapered projection 112 extending upwards from the center of the top plate 110*a* into the casing 101. The projection 112 is hollow and has a circular opening in its top. The side wall of the supporting member 110 under the top plate 110*a* is spaced a predetermined distance from the inner wall of the casing 101 to define a predetermined gap 109 for slidingly receiving a sliding member 122 which will be described below. The bottom of the supporting member 110 is open for holding a printed circuit board 113 therein.

The sliding member 122 has an outer wall 123 which is slidingly fitted into the gap 109. A body portion of the sliding member 122 has a large opening for receiving the projection 112. Provided on the top of the body portion of the sliding member 122 are four V-shaped recesses 124*a*, 124*b*, 124*c* and 124*d*, each adjacent two of which are peripherally spaced 90° from each other. The sliding member 122 is normally biased upwards, when viewed in FIG. 14, by four biasing springs 125 each extending between the sliding member 122 and the top plate 110*a* of the supporting member 110. For holding the biasing springs 125 in position, the sliding member 122 has recesses 126 in the body portion for accommodating the respective springs 125, as best shown in FIG. 14.

Figure 20:
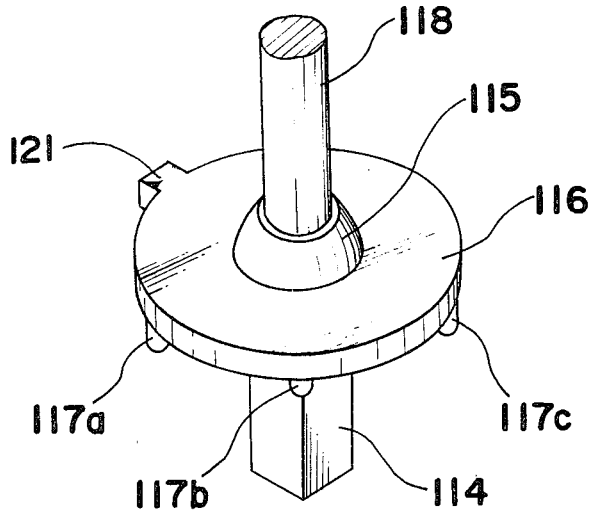
FIG. 20 is a perspective view of a major part of an operating lever incorporated in the complex switch assembly of FIG. 13.

A sphere 115, having the same structure as that described in connection with the first embodiment is rotatably held between the annular bottom edge of the wall defining the opening 107 and the annular top edge of the hollow projection 112. In FIG. 20, extending upwards from the sphere 115 is a bar 118 having a circular cross-section. The free end of the bar 118 remote from the sphere 115 has rigidly connected thereto a knob 119 having a fin for the indication of the position of the knob 119 around the axis of the bar 118. Extending downwards from the sphere 115 in the direction opposite to the bar 118 is a leg 114 having a rectangular cross-section. The sphere 115 is further provided with a ring plate 116 protruding radially outwards therefrom in a direction perpendicular to the axis of the bar 118. The ring plate 116 has four projections 117*a*, 117*b*, 117*c* and 117*d* which extend downwardly, each adjacent two of which are peripherally spaced 90° from each other. The ring plate 116 also has an engagement projection 121 extending outwardly from the peripheral edge of the ring plate 116 (FIG. 16).

Figure 16:
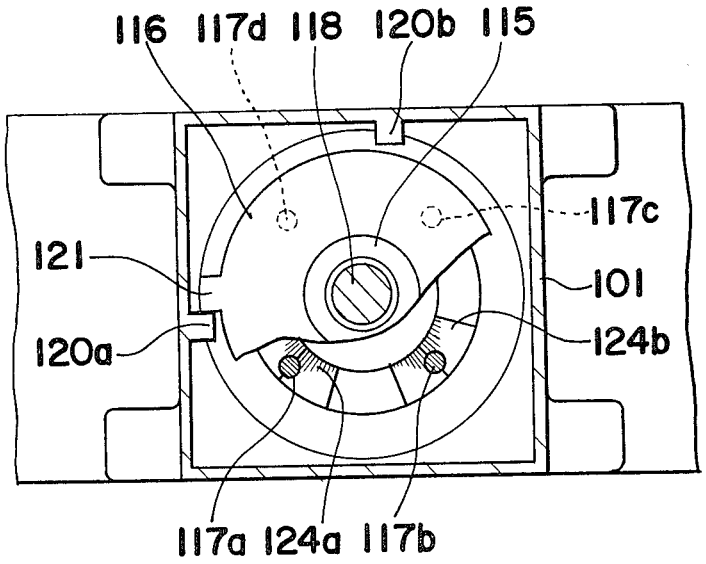
FIG. 16 is a cross-sectional view taken along the line XVI—XVI shown in FIG. 14.
Figure 17:
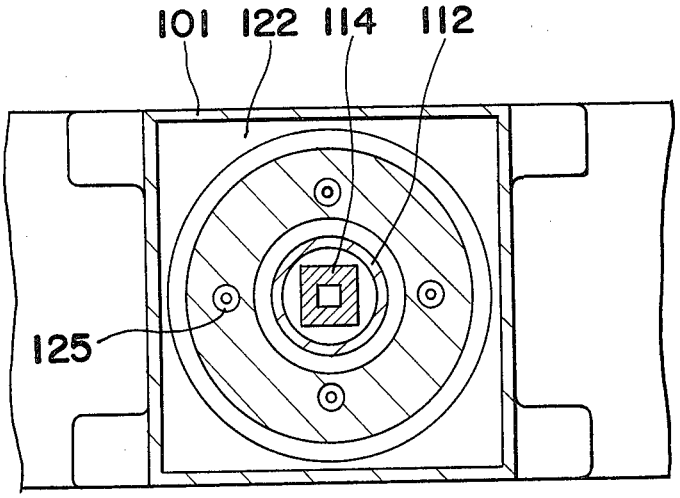
FIG. 17 is a cross-sectional view taken along the line XVII—XVII shown in FIG. 14.
Figure 18:
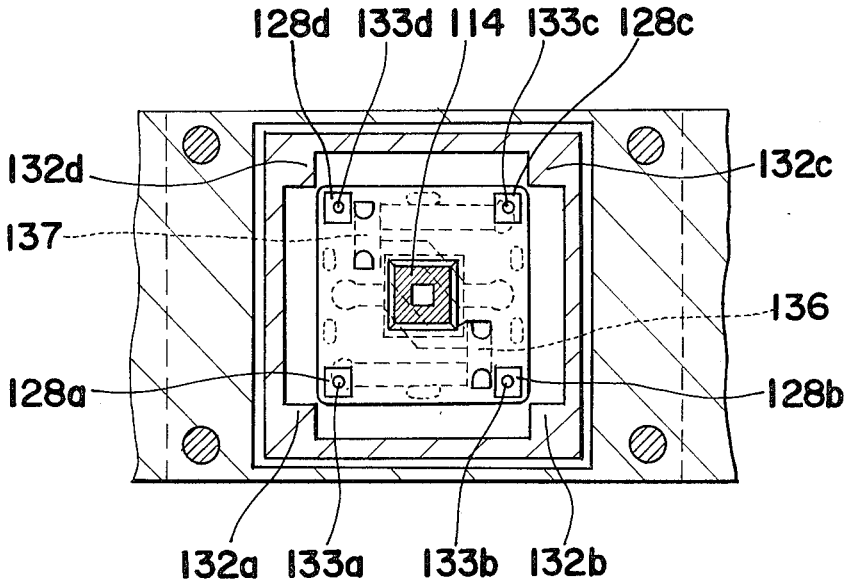
FIG. 18 is a cross-sectional view taken along the line XVIII—XVIII shown in FIG. 14.

Referring particularly to FIG. 16, when the sphere 115 is rotated about the axis of the bar 118 in a counter-clockwise direction by rotating the knob 119, the engagement projection 121 comes into contact with a projection 120*a* as shown to hold the sphere 115 in a first neutral position. On the other hand, when the sphere 115 is rotated in a clockwise direction, the engagement projection 121 comes into contact with a projection 120*b* to hold the sphere 115 in a second neutral position. The projections 120*a* and 120*b* are rigidly provided on the inner wall of the casing 101 and are peripherally spaced approximately 90° from each other about the center of the sphere 115. In each of the first and second neutral positions of the sphere 115, the projections 117*a* to 117*d* are engaged in the corresponding V-shaped recesses 124*a* to 124*d* in top of the body portion of the sliding member 122 for ensuring that the sphere 115 is held in the respective neutral position.

Figure 15:
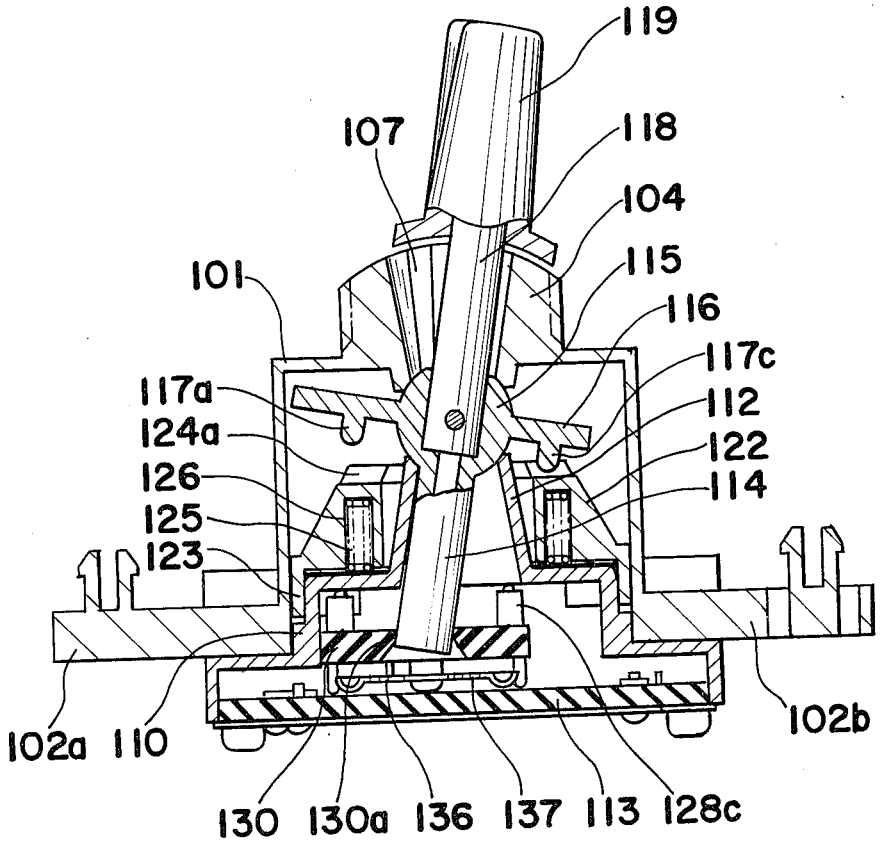
FIG. 15 is a view similar to FIG. 14 but, particularly showing the operating lever tilted in one of a plurality of directions.

In addition to the above, the sphere 115 is also rotatable about two axes perpendicular to the bar 118 only during the period in which the sphere 115 is held in either one of the first and second neutral positions, and this can be achieved by tilting the bar 118 in one of four directions, shown by the respective arrows R, L, U and D in FIG. 13 about the center of the sphere 115 by the application of an external force to the knob 119. FIG. 15 shows a position in which the bar 118 is tilted in the direction L. In the condition shown in FIG. 15, the projection 117*c* pushes the sliding member 122 down to cause the wall 123 to be inserted into the gap 109. When the external force for tilting the bar 118 is released, the sliding member 122 is raised up for returning the ring plate 116 back to a horizontal level as shown in FIG. 14, causing the sphere 115 to return to either one of the first or second neutral positions.

Figure 21:
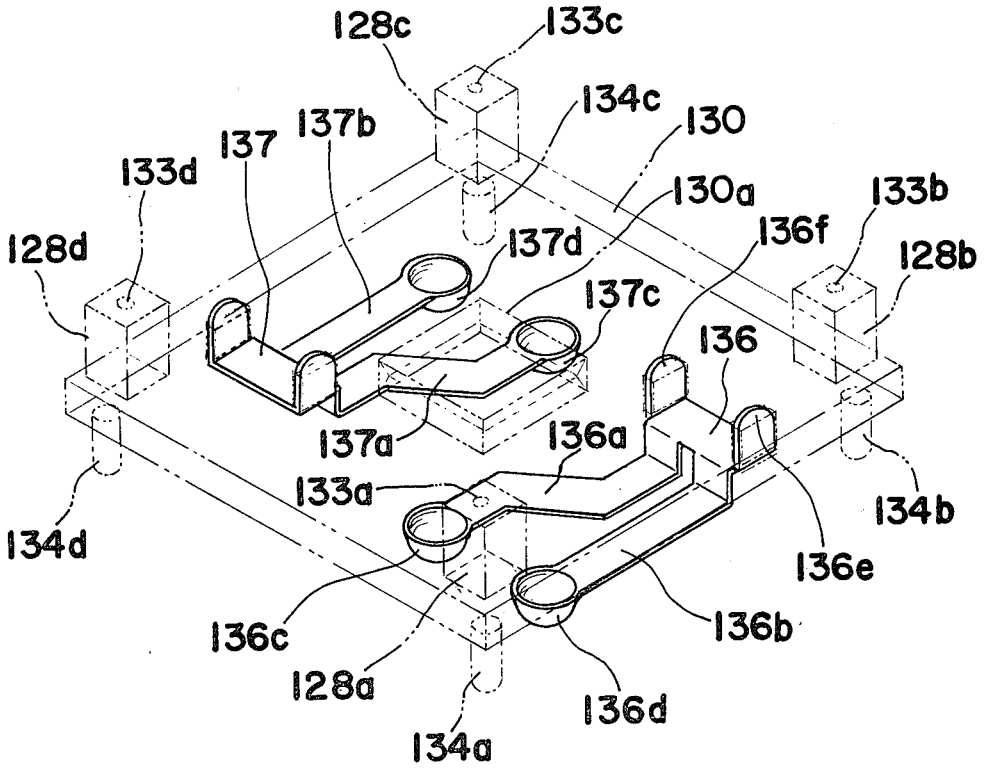
FIG. 21 is a perspective view of terminal members incorporated in the complex switch assembly shown in FIG. 13.
Figure 22:
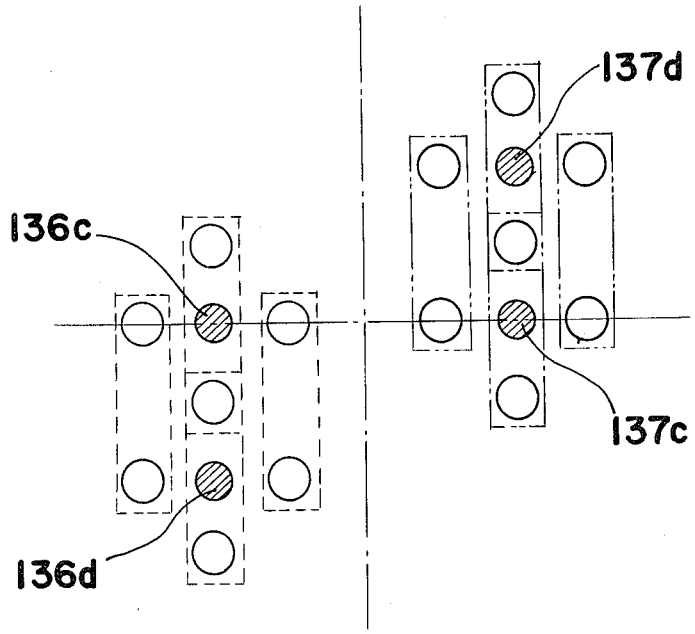
FIGS. 22 and 23 are diagrams showing the shifted positions of the terminal members.
Figure 23:
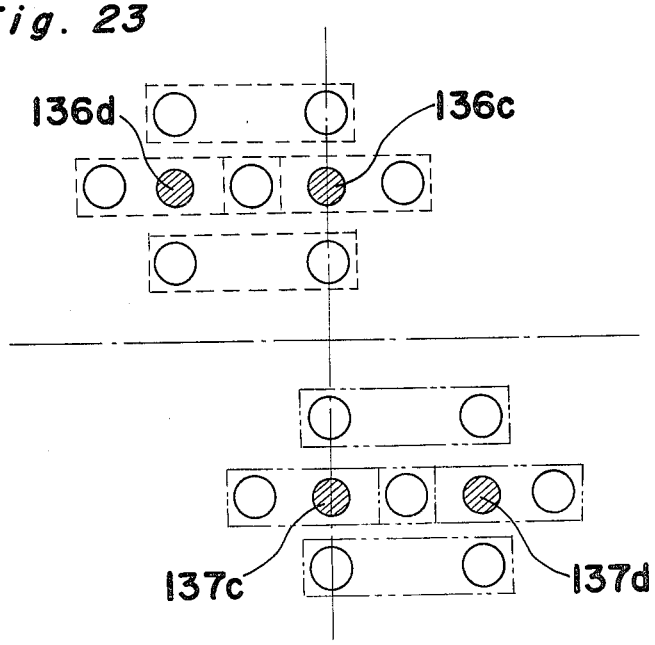

Referring to FIGS. 14 and 21, a movable contactor member 130 having a rectangular shape is movably provided in the supporting member 110. The movable contactor member 130 has, in its center, a rectangular opening 130*a* which is surrounded by a ridged edge in a manner similar to the opening 32*c* described above in the first embodiment, which has the leg 114 extending from the sphere 115 fitted therein. The movable contactor member 130 moves in a plane parallel to the printed circuit board 113 in a similar manner to the movable contactor member 32, described above in the first embodiment, in accordance with the movement of an operating lever Q which is constituted by the sphere 115, bar 118, leg 114 and knob 119. Accordingly the rotation of the bar 118 to bring the sphere 115 to the first or second neutral position, that is, the rotation of the operating lever Q to the first or second neutral position, brings the movable contactor member 130 to a first or second off position, respectively. From each of the off positions, the movable contactor member 130 can be shifted in four directions, i.e., right, left, back and forth directions in accordance with the tilting of the operating lever Q in the corresponding directions L, R, U and D.

There are provided four guide blocks 132*a*, 132*b*, 132*c* and 132*d* (FIG. 18) each at a corner under the top plate 110*a* for guiding the movable contactor member 130 having four projections 128*a*, 128*b*, 128*c* and 128*d* each projecting upwards at the corner of the body of the movable contactor member 130.

The movable contactor member 130 further has four spacer projections 133*a*, 133*b*, 133*c* and 133*d* on top of each of the the projections 128*a*, 128*b*, 128*c* and 128*d*, respectively, and four spacer projections 134*a*, 134*b*, 134*c* and 134*d* each projecting downwards at the corner of the body of the movable contactor member 130 for spacing the movable contactor member 130 a predetermined distance from the top plate 110*a* and also from the printed circuit board 113.

Two terminal members 136 and 137 (FIG. 21) made of electrically conductive material are rigidly provided under the movable contactor member 130. The terminal member 136 has two resilient arms 136*a* and 136*b* extending in a plane under and parallel to the movable contactor member 130. The one ends of the arms 136*a* and 136*b* are provided with cup-shaped contacts 136*c* and 136*d*, respectively, and the other ends thereof are connected with each other. The terminal member 136 further has a pair of lugs 136*e* and 136*f* which extend upwards and are inserted into holes extending through the contactor member 130 from the bottom. The ends of the lugs 136*e* and 136*f* projecting upwards from the contactor member 130 are bent over for rigidly connecting the terminal member 136 to the movable contactor member 130. Similarly, the terminal member 137 has two arms 137*a* and 137*b*, and cup-shaped contacts 137*c* and 137*d* at the one ends of the respective arms 137*a* and 137*b*. The terminal member 137 is also rigidly connected to the movable contactor member 130 in the same manner as the terminal member 136.

When the movable contactor member 130 is accommodated in the supporting member 110 in the manner shown in FIG. 14, the cup-shaped contacts 136*c*, 136*d*, 137*c* and 137*d* are held in contact with the printed circuit board 113 under the influence of the biasing force exerted by the respective arms. Since the cup-shaped contacts 136*c* and 136*d* are electrically connected with each other, when the cup-shaped contacts 136*c* and 136*d* contact portions of the conductive strips on the circuit board, the conductive strips are electrically connected with each other. Likewise, when the cup-shaped contacts 137*c* and 137*d* contact portions of the conductive strips on the board 113, the strips are electrically connected with each other.

Figure 19:
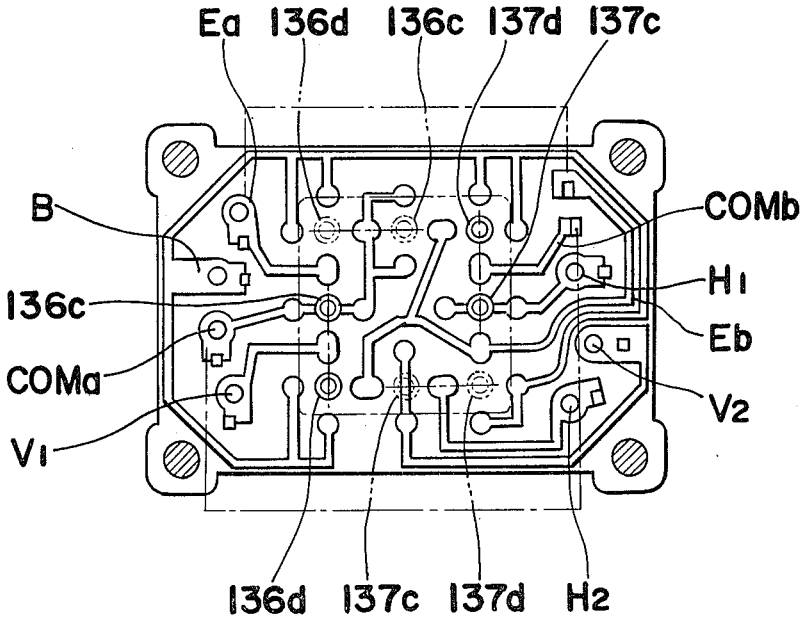
FIG. 19 is a top plan view of a printed circuit board incorporated in the complex switch assembly shown in FIG. 13.

Referring to FIG. 19, there is shown the pattern of the printed circuit on the circuit board 113. Deposited on the circuit board 113 are nine conductive strips Ea, Eb, B, COMa, COMb, V1, V2, H1 and H2. However, since the conductive strips Ea and Eb are connected in common with each other and the conductive strips COMa and COMb are in common with each other, there are actually seven different conductive strips which are connected to a corresponding one of seven terminals (not shown) for the external connection.

Figures 24, 25:
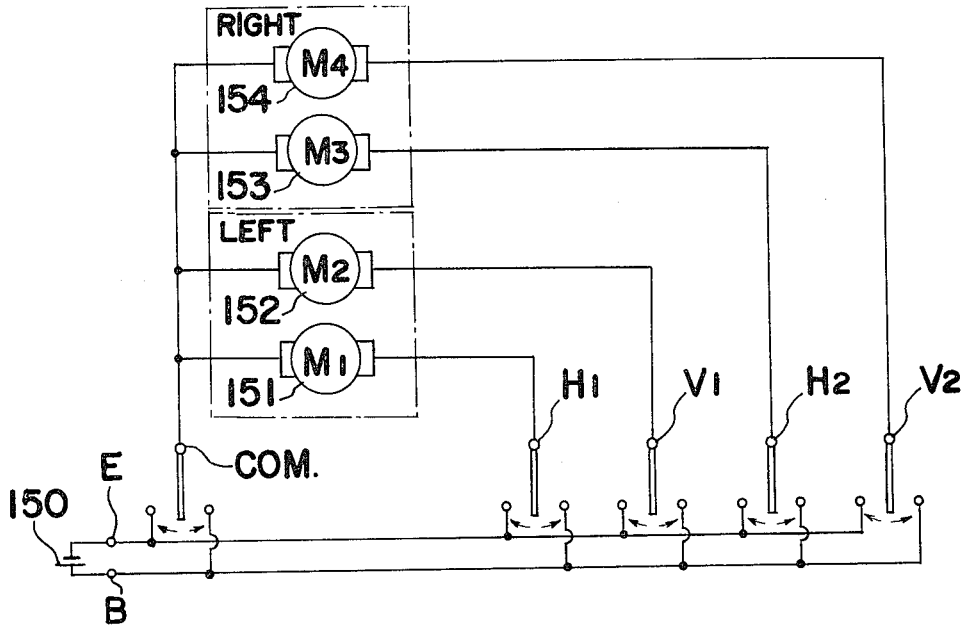
FIG. 24 is a circuit diagram of the complex switch assembly of FIG. 13 connected with an external circuit.
FIG. 25 is a chart showing connections of terminal members.

Referring to FIG. 24, the conductive strip B is connected to the positive side of a source of power such as a battery 150 and the conductive strips Ea and Eb, generally referred to as a conductive strip E, are connected to the negative side of the battery 150. A D.C. motor 151 which is of a type capable of rotating in both directions depending on the direction of flow of an electric current therethrough is connected between the conductive strips COM (the general indication for the conductive strips COMa and COMb) and H1. A.D.C. motor 152 of the same type as the motor 151 is connected between the conductive strips COM and V1. Similarly, a D.C. motor 153 of the same type is connected between the conductive strips COM and H2, and a D.C. motor of the same type is connected between the conductive strips COM and V2. Each of the conductive strips COM, H1, V1, H2 and V2 is so shaped as to be connected selectively with either one of the conductive strips E and B.

It is to be noted that the motors 151 and 152 are provided for controlling the angular position of a rear viewing mirror provided on the front left-hand side of a vehicle (not shown), and the motors 153 and 154 are provided for controlling the angular position of a rear viewing mirror provided on the front right-hand side of the vehicle. For example, each of the rear viewing mirrors is centrally pivotable about horizontal and vertical axes using screws connected with the back of the pivotable mirror, and is adapted to be advanced or retracted by rotatable nuts driven by different motors to selectively rotate one or the other of the nuts. Therefore, when the motor 151 is energized, the right and left angular position of the left-hand rear viewing mirror is controlled and, when the motor 152 is energized, the up and down angular position of the left-hand rear viewing mirror is controlled. In a similar manner, when the motor 153 is energized, the right and left angular position of the right-hand rear viewing mirror is controlled and, and when the motor 154 is energized, the up and down angular position of the right-hand rear viewing mirror is controlled.

Referring again to FIG. 19, when the operating lever Q is rotated to the first neutral position, the cup-shaped contacts 136*c*, 136*d*, 137*c* and 137*d* are located at positions indicated by the solid lines. On the other hand, when the operating lever Q is rotated to the second neutral position, the cup-shaped contacts 136*c*, 136*d*, 137*c* and 137*d* are located at positions indicated by the dotted lines.

When the operating lever Q positioned in the first neutral position is tilted in the direction U shown in FIG. 13, the cup-shaped contacts 136*c* and 136*d* are shifted downwards a predetermined distance (FIG. 22) for connecting the conductive strips B and V1 with each other and, at the same time, the cup-shaped contacts 137*c* and 137*d* are shifted down for connecting the conductive strips COM and E with each other. The above described connections are shown in the chart of FIG. 25. When the above connections are effected, current flows through the conductive strips B and V1 and the motor 152 and the conductive strips COM and E as shown in the chart of FIG. 26 for effecting upward angular movement of the left-hand rear viewing mirror.

When the operating lever Q positioned in the first neutral position is tilted in the direction D, the cup-shaped contacts 136*c* and 136*d* are shifted upwards a predetermined distance for connecting the conductive strips E and V1 with each other and, at the same time, the cup-shaped contacts 137*c* and 137*d* are shifted up for connecting the conductive strips B and COM with each other. When the above connections are effected, current flows through the conductive strips B and COM and the motor 152 and the conductive strips V1 and E for effecting downward angular movement of the left-hand rear viewing mirror.

When the operating lever Q positioned in the first neutral position is tilted in the direction L, the cup-shaped contacts 136*c* and 136*d* are shifted rightwards a predetermined distance for connecting the conductive strips E and COM with each other and, at the same time, the cup-shaped contacts 137*c* and 137*d* are shifted right for connecting the conductive strips B and H1 with each other. When the above connections are effected, current flows through the conductive strips B and H1 and the motor 151 and the conductive strips COM and E for effecting leftwards angular movement of the left-hand rear viewing mirror.

When the operating lever Q positioned in the first neutral position is tilted in the direction R, the cup-shaped contacts 136*c* and 136*d* are shifted leftwards a predetermined distance for connecting the conductive strips B and COM with each other and, at the same time, the cup-shaped contacts 137*c* and 137*d* are shifted left for connecting the conductive strips E and H1 with each other. When the above connections are effected, current flows through the conductive strips B and COM and the motor 151 and the conductive strips H1 and E for effecting rightwards angular movement of the left-hand rear viewing mirror.

The above operations apply to the case where the operating lever Q in the first neutral position is tilted for controlling the angular position of the left-hand rear viewing mirror. A similar angular adjustment of the right-hand mirror is carried out when the operating lever Q in its second neutral position is tilted for effecting similar electric connections to those described above. Therefore, a further description thereof is omitted.

It is to be noted that for facilitating the attachment of the complex switch assembly onto a panel or a dashboard (not shown), the projection 104 is threaded on its exterior surface or a pair of engagement pins 103*a* and 103*b* can be provided on the flanges 102*a* and 102*b*, respectively.

Modifications

Figure 27:
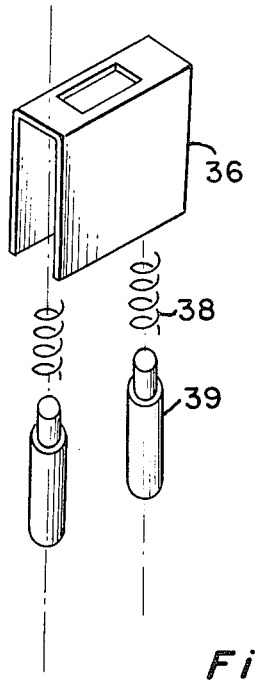
FIG. 27 is a view similar to FIG. 9, but particularly showing a modification thereof.

Although the complex switch assembly of the first embodiment has been described as designed for controlling each of the rear viewing mirrors by the use of a single motor and solenoid, it is possible to design the switch assembly of the first embodiment so that it is capable of controlling each of the rear viewing mirrors by the use of two motors. In this case, the printed circuit board 11 must be replaced by the printed circuit board 113 of the second embodiment, and the movable contactor member 32 must be provided with two connecting pins instead of three in each metal frame, as shown in FIG. 27.

Figure 28:
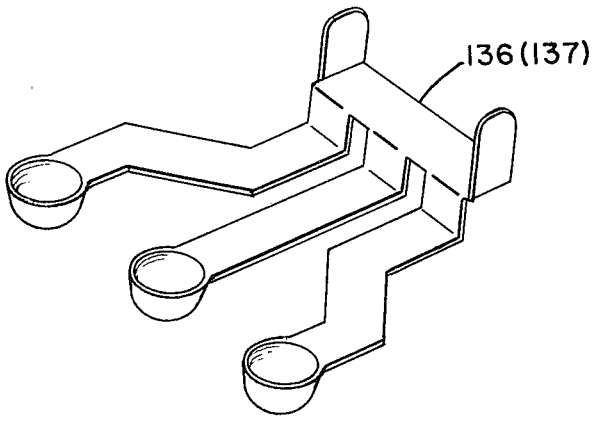
FIG. 28 is a view similar to FIG. 21, but particularly showing a modification thereof.

Similarly, the complex switch assembly of the second embodiment can be so designed as to control each of the rear viewing mirrors by the use of a single motor and solenoid. In this case, the printed circuit board 113 must be replaced by the printed circuit board 11 of the first embodiment and each of the terminal members 136 and 137 must have three cup-shaped contacts instead of two, as shown in FIG. 28.

Although the present invention has been fully described by way of examples with reference to the accompanying drawings, it is to be noted that various changes and modifications will be apparent to those skilled in the art. Therefore, such changes and modifications are, unless they depart from the true scope of the present invention, to be understood as being included therein.

What is claimed is:

1. A complex switch assembly comprising:

(a) a casing having a hollow interior and having a first opening defined in one end thereof;

(b) a supporting member having a second opening at the center thereof, said supporting member being rigidly mounted in the interior of said casing and spaced from said one end with said first and second openings in alignment with each other;

(c) an operating lever constituted by a sphere, a bar portion extending radially outwardly from the sphere and a leg portion extending radially outwardly from the sphere in a direction opposite to said bar portion, said sphere having a diameter larger than the size of both of said first and second openings, said sphere being rotatably held in position between said one end and said support member with portions protruding into the first and second openings and said bar portion extending outwardly from said casing through said first opening and said leg portion extending through said second opening, said operating lever, when it is located with said bar portion and said leg portion in alignment with an imaginary line extending between the centers of the first and second openings, being rotatable about the longitudinal axis of said bar portion between a plurality of different neutral positions at different rotational positions of said operating lever around said longitudinal axis, and said operating lever also being tiltable about the center of the sphere in a plurality of directions when the operating lever is in any one of the neutral positions;

(d) contact means fixedly mounted in said casing and having a plurality of pairs of contact portions for being connected to complete circuits to be controlled by said switch assembly; and (e) contactor means being mounted in said casing for shifting movement laterally across said contact means for shifting said contactor means into and out of contact with said pairs of contact portions and for rotational movement substantially around said line as an axis, said leg portion and said contactor means being connected for moving said contactor means in rotational movement upon rotation of the operating lever around said line and for shifting said contactor means laterally upon tilting of said operating lever.

2. A complex switch assembly as claimed in claim 1, further comprising a guiding means in said casing and engaged by said operating lever for guiding the operating lever for tilting in said directions.

3. A complex switch assembly as claimed in claim 2, wherein the number of the directions in which the operating lever is tiltable is four and wherein said guiding means is a wall surrounding said bar portion, said wall having a cross-shaped opening therein for allowing the operating lever to tilt in the four directions.

4. A complex switch assembly as claimed in claim 3, wherein said sphere has a ring protruding radially outwardly therefrom and in a direction perpendicular to said leg portion, said ring having four pin projections, each adjacent two of which are peripherally spaced 90° from each other around the center of the sphere, and said assembly further comprises a sliding member positioned between said ring and said supporting member for movement in a direction parallel to said imaginary line, and biasing means for biasing said sliding member towards said ring, said sliding member having four engagement recesses, each adjacent two of which are peripherally spaced 90° from each other around the imaginary line, for receiving respective ones of said four pin projections.

5. A complex switch assembly as claimed in claim 1, wherein said contact means comprises a printed circuit board rigidly mounted in the casing adjacent to one end of the leg portion remote from the sphere and perpendicular to said leg portion when said operating lever is located in any one of the neutral positions, said printed circuit board having a printed surface having deposited thereon a plurality of conductive strips facing the leg portion and which have said contact portions thereon; and said contactor means is located between said printed surface of said printed circuit board and said leg portion and pivotally connected to the end portion of the leg portion remote from the sphere, said contactor means having at least one contactor member thereon of electrically conductive material and held in contact with said printed surface of the printed circuit board.

6. A complex switch assembly as claimed in claim 5 wherein said contactor means has two contactor members thereon.

7. A complex switch assembly as claimed in claim 5, wherein said contactor means comprises a frame, at least two contact pins of electrically conductive material and electrically connected with each other, said two contact pins being housed in said frame, and biasing means engaged with said contact pins for biasing said pins outwardly of the contactor means towards and holding said outer ends thereof into contact with said printed surface.

8. A complex switch assembly as claimed in claim 7, wherein said contactor member has three contact pins.

9. A complex switch assembly as claimed in claim 5, wherein said contactor member comprises at least two metallic resilient arms, each having a cup-shaped contact on one end and having the outer end connected to the other arm, said cup-shaped contacts being held in contact with said printed surface by the resiliency thereof.

10. A complex switch assembly as claimed in claim 9, wherein said contactor member has three metallic resilient arms.

* * * * *